US011270582B1

(12) United States Patent
Jenkins

(10) Patent No.: US 11,270,582 B1
(45) Date of Patent: Mar. 8, 2022

(54) TRAFFIC LIGHT CONTROL SYSTEM

(71) Applicant: Jayson Jenkins, Columbia, SC (US)

(72) Inventor: Jayson Jenkins, Columbia, SC (US)

( * ) Notice: Subject to any disclaimer, the term of this patent is extended or adjusted under 35 U.S.C. 154(b) by 0 days.

(21) Appl. No.: 17/196,024

(22) Filed: Mar. 9, 2021

(51) Int. Cl.
*G08G 1/087* (2006.01)
*G08G 1/052* (2006.01)

(52) U.S. Cl.
CPC ..... *G08G 1/087* (2013.01); *G08G 1/052* (2013.01)

(58) Field of Classification Search
CPC ..... G08G 1/087; G08G 1/052
See application file for complete search history.

(56) References Cited

U.S. PATENT DOCUMENTS

| | | | | |
|---|---|---|---|---|
| 3,638,179 | A | 1/1972 | Coll | |
| 4,573,049 | A * | 2/1986 | Obeck | G08G 1/087 340/12.5 |
| 5,014,052 | A * | 5/1991 | Obeck | G08G 1/087 340/906 |
| 5,202,683 | A | 4/1993 | Hamer | |
| D361,731 | S | 8/1995 | Stegar | |
| 6,326,903 | B1 * | 12/2001 | Gross | G08G 1/087 340/902 |
| 6,987,464 | B2 | 1/2006 | Pearson | |
| 10,147,320 | B1 * | 12/2018 | Ellis | G08G 1/163 |
| 10,235,877 | B1 * | 3/2019 | Ellis | G05D 1/0088 |
| 10,446,025 | B2 | 10/2019 | Yu | |
| 10,650,673 | B1 | 5/2020 | Elsheemy | |
| 2013/0027221 | A1 * | 1/2013 | Johnson | G08G 1/087 340/902 |
| 2016/0155327 | A1 * | 6/2016 | Schlienz | G08G 1/07 340/907 |
| 2017/0032670 | A1 * | 2/2017 | Poornachandran | G08G 1/096775 |
| 2018/0005522 | A1 * | 1/2018 | Pogula | G08G 1/087 |
| 2018/0096595 | A1 * | 4/2018 | Janzen | G06K 9/0063 |
| 2019/0051151 | A1 * | 2/2019 | Mueck | G08G 1/0145 |
| 2020/0126412 | A1 | 4/2020 | James | |
| 2020/0193818 | A1 | 6/2020 | Cross | |

FOREIGN PATENT DOCUMENTS

| | | |
|---|---|---|
| KR | 101444213 B1 * | 9/2014 |
| WO | 2020124068 | 12/2019 |

* cited by examiner

*Primary Examiner* — Ojiako K Nwugo

(57) ABSTRACT

The traffic light control system comprises a plurality of traffic light control signal devices, an emergency vehicle, and a broadcast communication signal. The traffic light control system provides the emergency vehicle privileged access through a traffic intersection that is controlled by one or more individual traffic light control signal devices selected from the plurality of traffic light control signal devices. The emergency vehicle transmits a broadcast communication signal to each of the plurality of traffic light control signal devices. Each individual traffic light control signal generates a traffic control signal that halts all traffic through a controlled traffic intersection when the span of the calculated distance to the emergency vehicle is less than a previously determined initiation distance. The traffic light control system resumes normal traffic flow through the controlled traffic intersection when the emergency vehicle subsequently moves beyond a previously determined discontinuation distance.

10 Claims, 4 Drawing Sheets

TRAFFIC LIGHT CONTROL SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of traffic control signals including devices that override traffic control signals. (G08G1/087)

SUMMARY OF INVENTION

The traffic light control system is a traffic control system. The traffic light control system comprises a plurality of traffic light control signal devices, an emergency vehicle, and a broadcast communication signal. The traffic light control system provides the emergency vehicle privileged access through a traffic intersection that is controlled by one or more individual traffic light control signal devices selected from the plurality of traffic light control signal devices. The emergency vehicle transmits a broadcast communication signal to each of the plurality of traffic light control signal devices. Each individual traffic light control signal devices: a) receives the broadcast communication signal transmitted by the emergency signal; b) uses the received broadcast communication signal to calculate the span of the distance between each individual traffic light control signal device; c) generate a traffic control signal that halts all traffic through the controlled traffic intersection when the span of the calculated distance is less than a previously determined initiation distance; and, d) resumes normal traffic flow through the controlled traffic intersection when the emergency vehicle subsequently moves beyond a previously determined discontinuation distance.

These together with additional objects, features and advantages of the traffic light control system will be readily apparent to those of ordinary skill in the art upon reading the following detailed description of the presently preferred, but nonetheless illustrative, embodiments when taken in conjunction with the accompanying drawings.

In this respect, before explaining the current embodiments of the traffic light control system in detail, it is to be understood that the traffic light control system is not limited in its applications to the details of construction and arrangements of the components set forth in the following appreciate that the concept of this disclosure may be readily utilized as a basis for the design of other structures, methods, and systems for carrying out the several purposes of the traffic light control system.

It is therefore important that the claims be regarded as including such equivalent construction insofar as they do not depart from the spirit and scope of the traffic light control system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
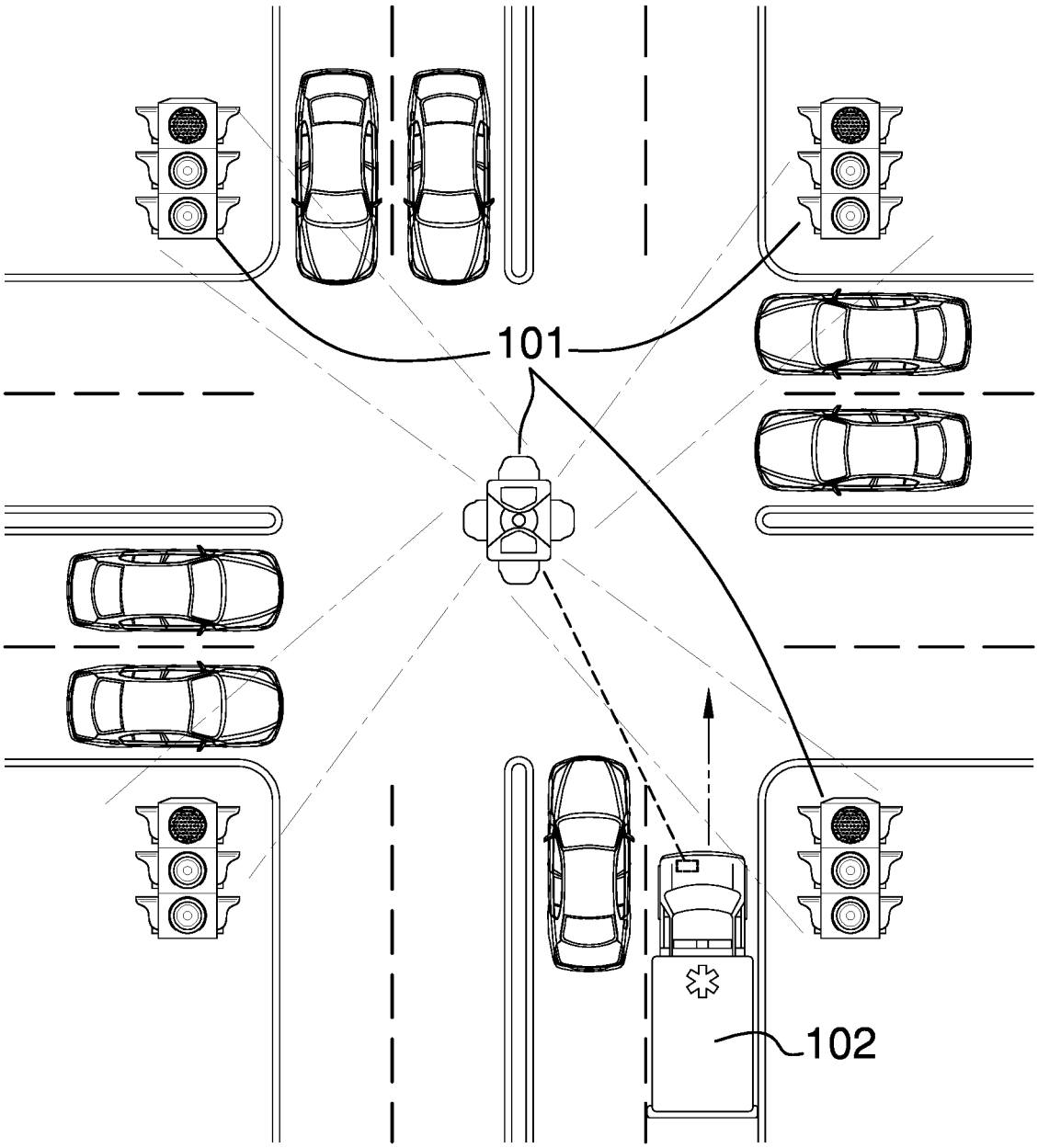
FIG. 1 is an in-use view of an embodiment of the disclosure.
Figure 2:
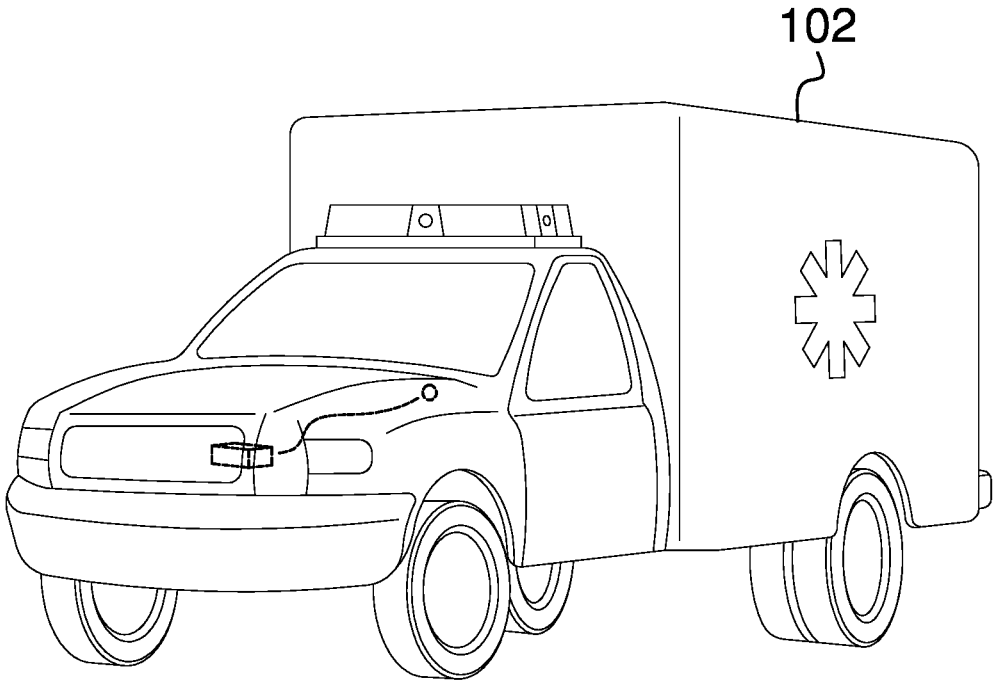
FIG. 2 is a perspective view of an embodiment of the FIG. 3 is a detail view of an embodiment of the disclosure.
Figure 3:
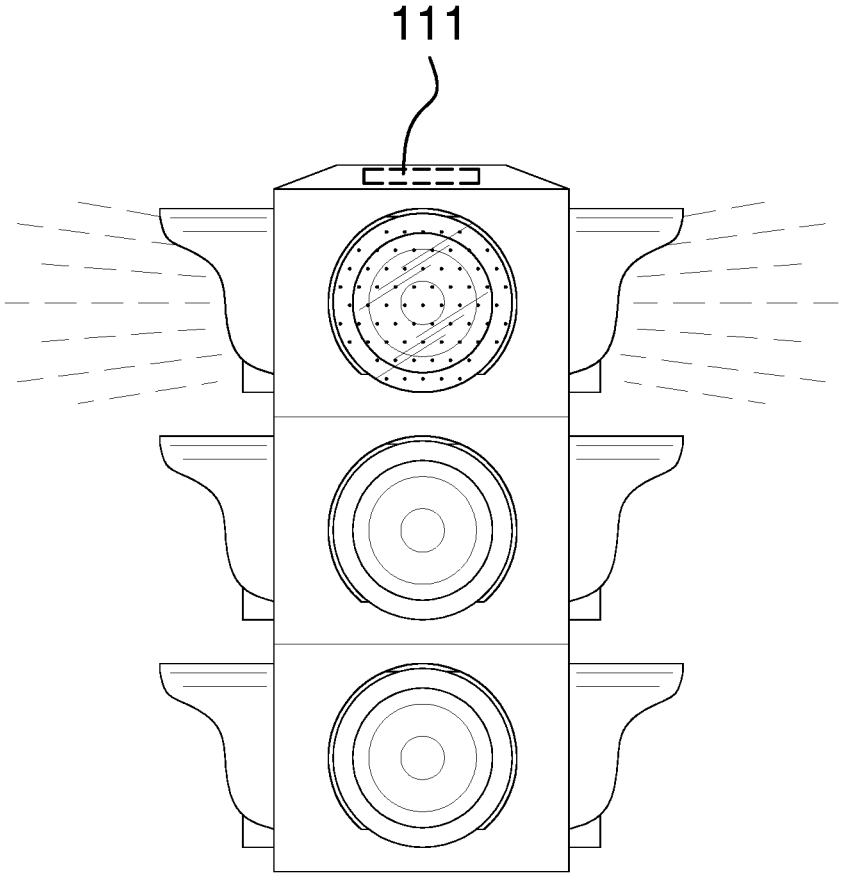
Figure 4:
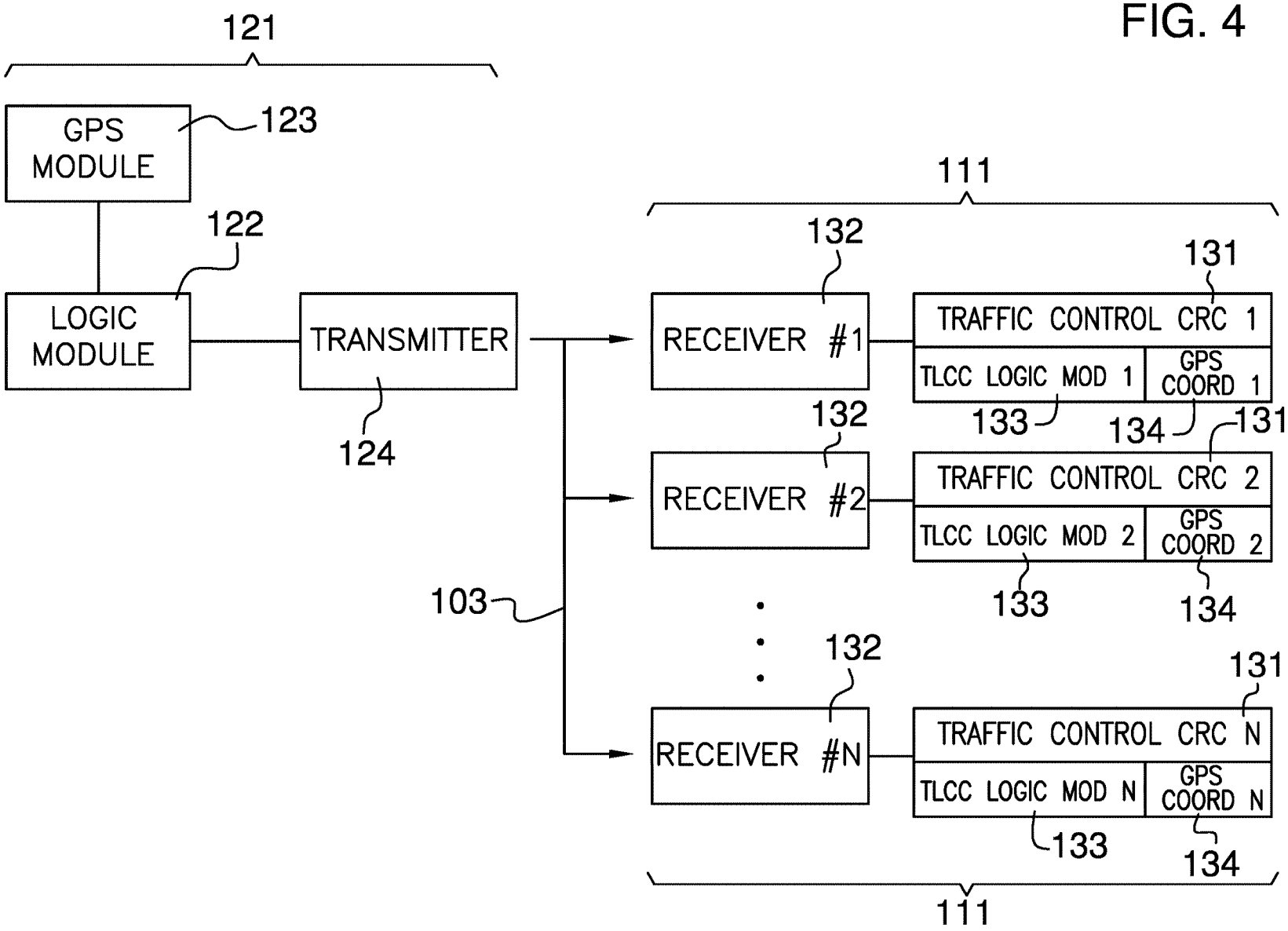
FIG. 4 is a schematic view of an embodiment of the disclosure.

Detailed reference will now be made to one or more potential embodiments of the disclosure, which are illustrated in FIGS. 1 through 4.

The traffic light control system 100 (hereinafter comprises a plurality of traffic light control signal devices 101, an emergency vehicle 102, and a broadcast communication signal 103. The invention 100 provides the emergency vehicle 102 privileged access through a traffic intersection that is controlled by one or more individual traffic light control signal devices 111 selected from the plurality of traffic light control signal devices 101. The emergency vehicle 102 transmits a broadcast communication signal 103 to each of the plurality of traffic light control signal devices 101. Each individual traffic light control signal device 111: a) receives the broadcast communication signal 103 transmitted by the emergency signal; b) uses the received broadcast communication signal 103 to calculate the span of the distance between each individual traffic light control signal device 111; c) generates a traffic control signal that halts all traffic through the controlled traffic intersection when the span of the calculated distance to the emergency vehicle 102 is less than a previously determined initiation distance; and, d) resumes the normal traffic flow through the controlled traffic intersection when the emergency vehicle 102 subsequently moves to a span of the calculated distance that is beyond a previously determined discontinuation distance.

The broadcast communication signal 103 is a radio frequency emergency vehicle 102 broadcasts the broadcast communication signal 103 to each of the plurality of traffic light control signal devices 101 within range of the emergency vehicle 102. The content of the broadcast communication signal 103 contains the GPS coordinates of the emergency vehicle 102. Each individual traffic light control signal device 111 selected from the plurality of traffic light control signal devices 101 extracts the GPS coordinates of the emergency vehicle 102 from the broadcast communication signal 103 and uses the GPS coordinates of the emergency vehicle 102 to calculate the span of the distance between the selected individual traffic light control signal device 111 and the emergency vehicle 102.

The emergency vehicle 102 is a motorized vehicle. The emergency vehicle 102 is defined elsewhere in this disclosure. The emergency vehicle 102 comprises an emergency traffic control circuit 121.

The emergency traffic control circuit 121 is an electric circuit. The emergency traffic control circuit 121 is activated when the emergency vehicle 102 is brought into service during an emergency. The emergency traffic control circuit 121 determines the GPS coordinates of the emergency vehicle 102. The emergency traffic control circuit 121 broadcasts the GPS coordinates of the emergency vehicle 102 using a broadcast communication signal included in the content of the broadcast communication signal 103. The emergency traffic control circuit 121 further comprises an ETEC logic module 122, an ETEC GPS module 123, and an ETEC transmitter 124. The ETEC logic module 122, the ETEC GPS module 123, and the ETEC transmitter 124 are electrically interconnected.

The ETEC logic module 122 is a readily and commercially available programmable electronic device that is used to manage, regulate, and operate the emergency traffic control circuit 121. The ETEC GPS module 123 is an electrical device that communicates with the GPS to determine the GPS coordinates of the ETEC GPS module 123. When queried by the ETEC logic module 122, the ETEC GPS module 123 transfers the GPS coordinates to the ETEC logic module 122. The ETEC transmitter 124 is a radio frequency transmitter. The ETEC transmitter 124 allows the ETEC logic module 122 to broadcast the GPS coordinates of the emergency vehicle 102 to each of the plurality of traffic light control signal devices 101 within range of the ETEC transmitter 124.

Each of the plurality of traffic light control signal devices 101 is an electrically powered device. Each of the plurality of traffic light control signal devices 101 controls the operation of a traffic control signal. The traffic control signal is an electrical device used to generate visible signals that are used to coordinate traffic through a controlled traffic intersection. The terms traffic control and traffic control signal are defined elsewhere in this disclosure.

The plurality of traffic light control signal devices 101 comprises a collection of individual traffic light control signal devices 111. The individual traffic light control signal device 111 is an electric circuit. The individual traffic light control signal device 111 coordinates the flow of traffic through a controlled traffic intersection. The individual traffic light control signal device 111 controls the operation of a traffic control signal. The traffic control signal is an electrical device used to generate visible signals that provide direction to the traffic flowing through the controlled traffic intersection.

During a normal traffic situation, the individual traffic light control signal device 111 coordinates the flow of traffic through the controlled traffic intersection based on the rules and signals that are determined by an appropriate authority. During an abnormal traffic situation, the individual traffic light control signal device 111 halts all traffic flow through the controlled traffic intersection. By abnormal traffic situation is meant that the calculated span of the distance between the individual traffic light control signal device 111 determined initiation distance. Upon returning to a normal traffic condition, the individual traffic light control signal device 111 returns to coordinating the flow of traffic through the controlled traffic intersection based on the rules and signals that are determined by an appropriate authority. By returning to a normal traffic condition is meant that the calculated span of the distance between the individual traffic light control signal device 111 and the emergency vehicle 102 is subsequently greater than a previously determined discontinuation distance.

The traffic light control circuit 131 coordinates the flow of traffic through a controlled traffic intersection. The traffic light control circuit 131 controls the operation of a traffic control signal. The traffic control signal is an electrical device used to generate visible signals provide direction to the traffic flowing through the controlled traffic intersection. During a normal traffic situation, the traffic light control circuit 131 coordinates the flow of traffic through the controlled traffic intersection based on the rules and signals that are determined by an appropriate authority. Each individual traffic light control signal device 111 comprises a traffic light control circuit 131 and a TLCC receiver 132. The traffic light control circuit 131 further 134. The traffic light control circuit 131 and the TLCC receiver 132 are electrically interconnected. The TLCC logic module 133 stores the TLCC GPS coordinates 134.

The traffic light control circuit 131 receives the GPS coordinates of the emergency vehicle 102 through the TLCC receiver 132. The traffic light control circuit 131 is provided with the TLCC GPS coordinates 134 during the installation of the traffic light control circuit 131. The TLCC GPS coordinates 134 are the GPS coordinates of the controlled traffic intersection that is coordinated by the traffic light control circuit 131. The TLCC logic module 133 uses the TLCC GPS coordinates 134 and GPS coordinates of the emergency vehicle 102 to calculate the span of the distance between the individual traffic light control signal device 111 and the emergency vehicle 102.

The TLCC logic module 133 is a readily and commercially available programmable electronic device that is used to manage, regulate, and operate the traffic light control circuit 131. The TLCC receiver 132 is a receiver that allows the TLCC logic module 133 to receive the GPS coordinates of the emergency vehicle 102 from the broadcast communication signal 103 that is broadcast from the emergency vehicle 102. The TLCC logic module 133 calculates the span of the distance between the GPS coordinates of the emergency vehicle 102 and the TLCC GPS coordinates 134 of the traffic light control circuit 131.

When the calculated span of distance between the emergency vehicle 102 and the traffic light control circuit 131 is lesser than a predetermined initiation distance, the TLCC logic module 133 sets the traffic control signals to halt all traffic through the controlled traffic intersection under the supervision of the traffic light control circuit 131. When the calculated span of distance between the emergency vehicle 102 and the traffic light control circuit 131 subsequently is greater than a predetermined discontinuation distance, the TLCC logic module 133 resets the traffic control signals to resume normal traffic flows through the controlled traffic intersection under the supervision of the traffic light control circuit 131.

The following definitions were used in this disclosure:

Appropriate Authority: As used in this disclosure, an appropriate authority is a previously determined person who has been authorized to operate a device.

Broadcast: As used in this disclosure, a broadcast refers to a radio frequency transmission intended to be received by a plurality of receivers.

Communication Link: As used in this disclosure, a communication link refers to the structured exchange of data between two objects.

Control Circuit: As used in this disclosure, a control circuit is an electrical circuit that manages and regulates the behavior or operation of a device.

Emergency Vehicle: As used in this disclosure, an emergency vehicle is a vehicle that is operated on a road network by an appropriate authority. The emergency vehicle is equipped with visible and audible alarms and markings that indicate that the emergency vehicle operates as a privileged vehicle under traffic regulations and that other vehicles operating on the road network are required yield their rights under the traffic regulations to the emergency vehicle.

GPS: As used in this disclosure, and depending on the context, GPS refers to: 1) a system of navigational satellites that are used to determine the position, known as GPS coordinates, and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System. Methods to determine the distance and direction between any two sets of GPS coordinates are well-known and documented in the navigational arts.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Receiver: As used in this disclosure, a receiver is an electric device that is used to receive and demodulate electromagnetic radiation such as radio signals.

Supervision: As used in this disclosure, supervision refers to an individual or system that observes and provides direction for the operation of: a) one or more individuals; or, b) a process.

Traffic: As used in this disclosure, traffic refers to the simultaneous movement of a plurality of vehicles and pedestrians.

Traffic Control: As used in this disclosure, traffic control refers to a system of rules and signals that supervise the flow of traffic over a road network.

Traffic Control Signal: As used in this disclosure, a traffic control signal is an electrically powered device. The traffic control signal generates one or more visual distinct signals used for directing and controlling traffic flow through a location. A traffic control signal is often called a traffic light.

Transmitter: As used in this disclosure, a transmitter is a device that is used to generate and transmit electromagnetic radiation such as radio signals.

Vehicle: As used in this disclosure, a vehicle is a motorized device that is used for transporting passengers, goods, or equipment. The term motorized vehicle refers to a vehicle can move under power provided by an electric motor or an internal combustion engine. A motorized vehicle further comprises an electrical system that can be used as a source of electric energy.

Wireless: As used in this disclosure, wireless is an adjective that is used to describe a communication link between two devices that does not require the use of physical cabling.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A traffic light control system comprising a plurality of traffic light control signal devices, an emergency vehicle, and a broadcast communication signal;

wherein the emergency vehicle transmits the broadcast communication signal to each of the plurality of traffic light control signal devices;

wherein the traffic light control system is a traffic control system;

wherein the traffic light control system provides the emergency vehicle privileged access through a traffic intersection that is controlled by one or more individual traffic light control signal devices selected from the plurality of traffic light control signal devices;

wherein the broadcast communication signal is a radio frequency transmission transmitted from the emergency vehicle;

wherein the emergency vehicle broadcasts the broadcast communication signal to each of the plurality of traffic light control signal devices within range of the emergency vehicle;

wherein the content of the broadcast communication signal contains the GPS coordinates of the emergency vehicle;

wherein each individual traffic light control signal device selected from the plurality of traffic light control signal devices extracts the GPS coordinates of the emergency vehicle from the broadcast communication signal and uses the GPS coordinates of the emergency vehicle to calculate the span of the distance between the selected individual traffic light control signal device and the emergency vehicle.

2. The traffic light control system according to claim 1 wherein each individual traffic light control signal device: a) receives the broadcast communication signal transmitted by the emergency signal; b) uses the received broadcast communication signal to calculate a span of a distance between each individual traffic light control signal device; c) generates a traffic control signal that halts all traffic through the controlled traffic intersection when the span of a calculated distance to the emergency vehicle is less than a previously determined initiation distance; and, d) resumes the normal traffic flow through the controlled traffic intersection when the emergency vehicle subsequently moves to a span of the calculated distance that is beyond a previously determined discontinuation distance.

3. The traffic light control system according to claim 2 wherein the emergency vehicle comprises an emergency traffic control circuit;

wherein the emergency traffic control circuit is an electric circuit;

wherein the emergency traffic control circuit determines the GPS coordinates of the emergency vehicle;

wherein the emergency traffic control circuit broadcasts the GPS coordinates of the emergency vehicle using a broadcast communication signal;

wherein the GPS coordinates of the emergency vehicle are included in the content of the broadcast communication signal.

4. The traffic light control system according to claim 3 wherein each of the plurality of traffic light control signal devices is an electrically powered device;

wherein each of the plurality of traffic light control signal devices controls the operation of a traffic control signal;

wherein the traffic control signal is an electrical device used to generate visible signals that are used to coordinate traffic through a controlled traffic intersection.

5. The traffic light control system according to claim 4 wherein the plurality of traffic light control signal devices comprises a collection of individual traffic light control signal devices;

wherein the individual traffic light control signal device is an electric circuit;

wherein the individual traffic light control signal device coordinates the flow of traffic through a controlled traffic intersection;

wherein the individual traffic light control signal device controls the operation of a traffic control signal;

wherein the traffic light control circuit coordinates the flow of traffic through a controlled traffic intersection;

wherein the traffic light control circuit controls the operation of a traffic control signal;

wherein the traffic control signal is an electrical device used to generate visible signals that provide direction to the traffic flowing through the controlled traffic intersection.

6. The traffic light control system according to claim 5 wherein during a normal traffic situation, the individual traffic light control signal device coordinates the flow of traffic through the controlled traffic intersection based on the rules and signals that are determined by an appropriate authority;

wherein during an abnormal traffic situation, the individual traffic light control signal device halts all traffic flow through the controlled traffic intersection;

wherein by abnormal traffic situation is meant that the calculated span of the distance between the individual traffic light control signal device and the emergency vehicle is less than a previously determined initiation distance;

wherein upon returning to a normal traffic condition, the individual traffic light control signal device returns to coordinating the flow of traffic through the controlled traffic intersection based on the rules and signals that are determined by an appropriate authority;

wherein by returning to a normal traffic condition is meant that the calculated span of the distance between the individual traffic light control signal device and the emergency vehicle is subsequently greater than a previously determined discontinuation distance.

7. The traffic light control system according to claim 6 wherein the emergency traffic control circuit further comprises an ETEC logic module, an ETEC GPS module, and an ETEC transmitter;

wherein the ETEC logic module, the ETEC GPS module, and the ETEC transmitter are electrically interconnected.

8. The traffic light control system according to claim 7 wherein the ETEC GPS module is an electrical device that communicates with the GPS to determine the GPS coordinates of the ETEC GPS module;

wherein when queried by the ETEC logic module, the ETEC GPS module transfers the GPS coordinates to the ETEC logic module;

wherein the ETEC transmitter is a radio frequency transmitter;

wherein the ETEC transmitter allows the ETEC logic module to broadcast the GPS coordinates of the emergency vehicle to each of the plurality of traffic light control signal devices within range of the ETEC transmitter.

9. The traffic light control system according to claim 8 wherein each individual traffic light control signal device comprises a traffic light control circuit and a TLCC receiver;

wherein the traffic light control circuit further comprises a TLCC logic module and a TLCC GPS coordinates;

wherein the traffic light control circuit and the TLCC receiver are electrically interconnected;

wherein TLCC logic module stores the TLCC GPS coordinates;

wherein the TLCC GPS coordinates are the GPS coordinates of the controlled traffic intersection that is coordinated by the traffic light control circuit.

10. The traffic light control system according to claim 9 wherein the traffic light control circuit receives the GPS coordinates of the emergency vehicle through the TLCC receiver;

wherein the TLCC receiver is a receiver that allows the TLCC logic module to receive the GPS coordinates of the emergency vehicle from the broadcast communication signal that is broadcast from the emergency vehicle;

wherein the TLCC logic module calculates the span of the distance between the GPS coordinates of the emergency vehicle and the TLCC GPS coordinates of the traffic light control circuit.

* * * * *